United States Patent [19]

Essock et al.

[11] Patent Number: 4,835,439

[45] Date of Patent: May 30, 1989

[54] INCREASING THE OXIDATION RESISTANCE OF MOLYBDENUM AND ITS USE FOR LAMP SEALS

[75] Inventors: Diana M. Essock, Moreland Hills; Richard F. Malinowski, Chesterland, both of Ohio

[73] Assignee: General Electric Company, Schenectady, N.Y.

[21] Appl. No.: 101,928

[22] Filed: Sep. 29, 1987

[51] Int. Cl.[4] ..... H01J 5/38

[52] U.S. Cl. ..... 313/332; 313/331; 313/623; 106/74; 106/14.05; 106/286.7; 148/279; 174/50.64; 427/117; 427/126.1; 428/432

[58] Field of Search ..... 313/331, 332, 623; 174/50.64, 50.61; 428/364; 427/117, 118, 120, 126.1; 148/6, 6.11, 6.14 R, 423; 106/74, 14.05, 286.7

[56] References Cited

U.S. PATENT DOCUMENTS

| | | | |
|---|---|---|---|
| Re. 25,630 | 8/1964 | Cook | 204/39 |
| 2,665,475 | 1/1954 | Campbell et al. | 148/6 |
| 2,673,945 | 3/1954 | Kaduk | 427/117 X |
| 2,804,406 | 8/1957 | Yntema et al. | 148/6 |
| 3,420,944 | 1/1969 | Holcomb | 174/50.64 X |
| 3,532,591 | 10/1970 | Fosnocht | 427/120 X |
| 3,742,117 | 6/1973 | Levand, Jr. et al. | 313/332 X |
| 3,793,615 | 2/1974 | Homowway | 313/331 X |
| 3,929,439 | 12/1975 | Pierce | 106/74 X |
| 4,015,165 | 3/1977 | Hardies | 313/318 |
| 4,169,238 | 9/1979 | English et al. | 313/113 X |
| 4,539,509 | 9/1985 | Varshiyeya | 313/623 |
| 4,677,388 | 6/1987 | Dixon | 313/43 |
| 4,682,071 | 6/1987 | Thorpe | 313/43 |
| 4,749,902 | 6/1988 | Weiss | 313/332 |
| 4,755,712 | 7/1988 | Mujahid et al. | 313/331 |

FOREIGN PATENT DOCUMENTS

| | | | |
|---|---|---|---|
| 780614 | 8/1957 | United Kingdom | 174/50.64 |

*Primary Examiner*—Howard W. Britton
*Assistant Examiner*—Mark R. Powell
*Attorney, Agent, or Firm*—Edward M. Corcoran; Stanley C. Corwin; Fred Jacob

[57] ABSTRACT

The life of electric lamps exposed to an oxidizing environment at elevated temperature and having hermetic seals between molybdenum and a vitreous material is substantially increased by applying alkali metal silicate to the surface of that portion of the molybdenum in the seal area which is exposed to said oxidizing environment.

35 Claims, 3 Drawing Sheets

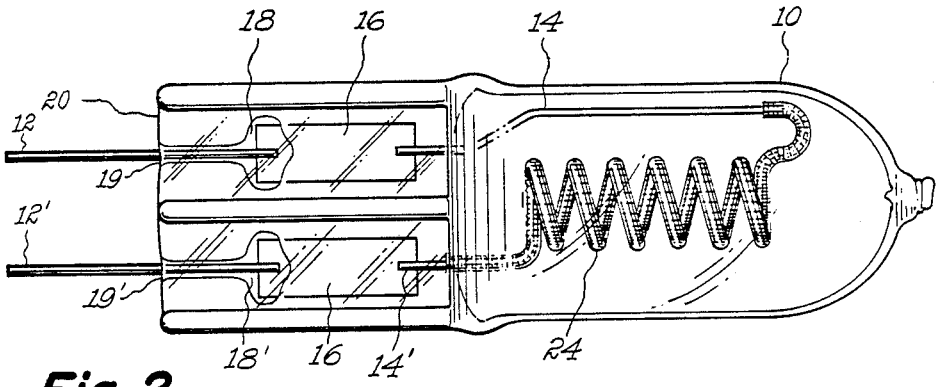
Fig. 2
Fig. 3
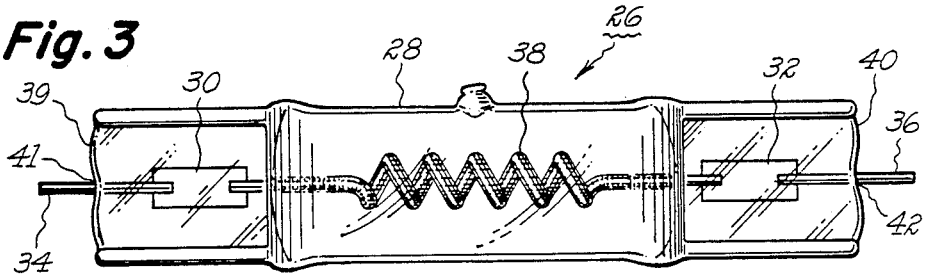

INCREASING THE OXIDATION RESISTANCE OF MOLYBDENUM AND ITS USE FOR LAMP SEALS

BACKGROUND OF THE INVENTION

1. Field of Invention

This invention relates to increasing the oxidation resistance of molybdenum, its preparation and its use in electric lamps for seals between molybdenum and a vitreous material. More particularly, this invention relates to a method for increasing the oxidation resistance of molybdenum exposed to an oxidizing environment at temperatures between about 250°-600° C. and its use for increasing the life of hermetic seals between molybdenum and electric lamps employing such seals, wherein that portion of the molybdenum in the seal area exposed to the oxidizing environment is coated with alkali metal silicate.

2. Background of the Disclosure

The use of molybdenum foil for effecting a hermetic seal with vitreous materials, such as pinch seals and vacuum-formed seals for quartz lamp envelopes, is old and well known to those skilled in the art. Molybdenum is an oxidation-sensitive material and oxidizes rapidly in an oxidizing environment such as air at temperatures of about 350° C. and higher. In the case of molybdenum foil used for hermetic pinch and vacuum-formed seals, this oxidation can result in an open circuit or can crack open the seal, either of which results in lamp failure. In many instances it is also preferred to use molybdenum wire for the outer current conductors which should be locked deeply in the seal area, so as to be able to withstand the forces which occur when the lamp is connected to the current source. Most quartz-molybdenum hermetic seals are satisfactory up to a seal temperature of approximately 350° C. At temperatures of about 350° C. and higher, the rate of the oxidation reaction between the oxygen in the surrounding atmosphere and the molybdenum foil greatly increases and results in a substantial reduction in the useful life of lamps employing hermetic seals between molybdenum and a vitreous material. The oxidation reaction takes place, because during the sealing operation microscopic passage ways are formed around the lead wires as the vitreous material cools. The passage ways or cracks permit oxygen to enter the foil area of the lamp seal.

In the formation of a pinch seal or vacuum seal with a vitreous material such as quartz, the quartz does not completely attach itself to the relatively heavier outer and inner lead wires, due at least in part to the relatively high viscosity of the quartz. Another reason for the microscopic passageways, which exist not only along the outer lead wire, but also along the outer edge of the foliated portion perpendicular to the transverse axis of the lamp, is the substantial difference in the coefficient of thermal expansion of the quartz compared to that of the refractory metal outer lead wire, which is usually tungsten or molybdenum.

These seals have always been a source of potential premature lamp failure and many attempts have been made to produce better seals. Efforts have been made in the past to prevent the oxidation of that portion of the molybdenum foil area which is exposed to atmospheric oxygen because of the passageways formed in the pinch seal. One such attempt, in U.S. Pat. No. 3,420,944, discloses coating the outer half of the molybdenum foil with a thin film of chromium. This was accomplished by forming the foil seal from two pieces of molybdenum foil. One piece was plated with chromium and the other was not plated. Both pieces were then tack welded together. Although this solved some oxidation problems, it created other problems relating to reduced mechanical strength and foil flatness. Also, if the chromium coating was too thick it introduced an oxygen passage from the outside of the lamp envelope to the unplated foil portion. Consequently, another attempt was made which is disclosed in U.S. Pat. No. 3,793,615. This patent discloses a tungsten-halogen lamp having a pinch seal over molybdenum foil wherein only about half of the molybdenum foil is coated with a layer of chromium. The plating is in the form of a wedge or taper, with the greatest thickness of the chromium layer being at the outer edge of the foliated portion and a comparatively thin portion located on that part of the foil which forms a part of the hermetic seal between the foil and quartz. This patent also suggests that the chromium film may possibly be replaced by nickel, molybdenum disilicide and alloys of chromium and nickel.

In U.S. Pat. No. 4,015,165 a proposed solution to a problem of the oxidation of molybdenum outer current conductors of electric lamps having a quartz glass lamp envelope with a pinch seal consists of covering the molybdenum outer conductors with a coating or sleeve of oxidation resistant material, such as nickel plated brass. U.S. Pat. No. 4,539,509 discloses applying a sealing glass composition to the small space or passage between the outer leads and the quartz. The sealing glass becomes molten at temperatures above 350° C. and thereby forms a hermetic seal between the quartz and conductors.

More recent attempts to alleviate the oxidation problem of molybdenum foil seals exposed to air are disclosed in U.S. Pat. Nos. 4,677,338 and 4,682,071 which relate to both incandescent lamps and discharge lamps having quartz envelopes with substantially elongated stem portions for the pinch seal. The outer face or surface of the elongated seal area stem is highly polished or coated, ribbed, twisted or otherwise modified so that a portion of radiation incident upon it from the light source is directed away from the foil and adjacent region of the terminal conductor. This is done in order to reduce the temperature of the seal area at the outer portion and thereby reduce oxidation of the molybdenum. The '358 patent also states that lamp failure due to oxidation of the molybdenum can be a problem at temperatures as low as about 250° C.

Notwithstanding the above, a serious problem still exists with respect to preventing the oxidation of both molybdenum foil seals at the foil-air interface and molybdenum or molybdenum coated conductors or other objects exposed to an oxidizing environment at temperatures above about 350° C. Thus the need still exists for a practical and facile solution to the problem of such molybdenum oxidation.

SUMMARY OF THE INVENTION

The present invention relates to increasing the oxidation resistance of molybdenum exposed to an oxidizing environment at temperatures up to about 600° C. by coating the surface of the molybdenum with at least one alkali metal silicate, such as potassium silicate. Thus, the molybdenum is made more oxidation resistant by coating the surface thereof with an alkali metal silicate.

This discovery has resulted in quartz to molybdenum hermetic seals of substantially improved oxidation resistance when exposed to an oxidizing environment such as air at elevated temperatures not exceeding about 600° C. and concomitant increased life of lamps employing such seals which are exposed to an oxidizing environment at such elevated temperatures. Thus, one embodiment of the present invention relates to seals between molybdenum and a vitreous material having increased life when exposed to an oxidizing environment at elevated temperatures not exceeding 600° C., wherein that portion of the molybdenum in the seal which is exposed to said oxidizing environment has a coating at least one alkali metal silicate.

Another embodiment of the present invention relates to an electric lamp comprising a vitreous envelope having a refractory metal inlead construction comprising a molybdenum foil portion sealed into at least one end thereof and extending into said vitreous envelope. Illustrative, but non-limiting examples of such suitable inlead constructions include those comprising (i) an outer terminal lead, an intermediate molybdenum sealing foil which forms a hermetic seal with said vitreous envelope and an inner lead extending into said envelope, wherein said inner and outer leads are connected to opposite ends of said sealing foil and (ii) those wherein the foliated molybdenum which forms a hermetic seal with the vitreous envelope is transverse to the leads, such as a molybdenum foil flange on a metal lead, wherein that portion of said molybdenum foil adjacent said outer terminal lead which is exposed to an oxidizing environment has been coated with at least one alkali metal silicate.

Yet another embodiment of the present invention relates to a reflector and lamp combination having improved life which comprises a reflector member having a front reflecting portion terminating in an elongated hollow cavity portion and a lamp, such as a tungsten halogen lamp, permanently secured in said hollow cavity portion with a cement so that its light source is positioned at about the focal point of said reflector member. The lamp will comprise a quartz envelope having a refractory metal inlead construction pinch sealed into one end thereof and extending into said envelope, wherein said inlead construction comprises an outer terminal lead, an intermediate molybdenum sealing foil which forms a hermetic seal with said quartz envelope and an inner lead extending into said envelope wherein said inner and outer leads are connected to opposite ends of said sealing foil and wherein that portion of said molybdenum foil adjacent to said outer terminal lead which is exposed to an oxidizing environment is coated with at least one alkali metal silicate.

In a particularly preferred embodiment, the metal outer leads of the seal, preferably a refractory metal such as tungsten or molybdenum, will be coated or plated with a metal, such as nickel, which does not adhere to the quartz or other vitreous material. This has been found to provide a more facile path for an aqueous alkali metal silicate solution to penetrate into the seal area and coat the outer portion of the molybdenum foil seal.

BRIEF DESCRIPTION OF THE DRAWINGS

FIG. 1(*a*) is a partial cut-away side view of FIG. 1.

FIG. 2 is a view depicting a single ended tungsten-halogen lamp having two inlead constructions hermetically pinch sealed in a quartz envelope.

FIG. 3 is a view of a double ended tungsten-halogen lamp containing a quartz to molybdenum hermetic pinch seal at each end thereof useful with the present invention.

DETAILED DESCRIPTION

As set forth above, oxidation of the molybdenum in hermetic seals between molybdenum and a vitreous material, such as quartz, at elevated temperatures and under oxidizing conditions has been a problem which continues to plague the lamp industry. Thus, the present invention, relating to the discovery that applying alkali metal silicate to molybdenum exposed to an oxidizing environment at elevated temperature increases the oxidation resistance of the molybdenum, represents a significant advance to the art, particularly as it applies to extending the useful life of electric incandescent and arc discharge lamps employing a hermetic seal between the vitreous material of the lamp envelope or arc tube and a molybdenum sealing foil.

By vitreous material is generally meant a material such as quartz or relatively high temperature glass composition, such as aluminosilicate glasses. However, any vitreous material which will form a hermetic seal with molybdenum is suitable. By elevated temperature is meant a temperature of at least about 250° C., which is a temperature at which the oxidation of molybdenum can begin to be a problem. The elevated temperature may broadly range from about 250°–600° C. The rate at which molybdenum oxidizes has been found to significantly increase at a temperature of about 350° C. Accordingly, the present invention has been found to be particularly useful for increasing the oxidation resistance of molybdenum exposed to an oxidizing environment at temperatures in the range of about 350°–600° C. and has been found to significantly increase the useful life of lamps having hermetic seals between a molybdenum sealing foil and the vitreous material of the lamp envelope. The present invention has been found not to be effective at temperatures exceeding about 600° C.

Application of the alkali metal silicate to the molybdenum in the seal area may be accomplished in a facile manner simply by applying an aqueous solution of alkali metal silicate to the outer end of the seal. Wetting forces and capilary action act to cause the alkali metal silicate solution to penetrate into the cavity or cavities between the vitreous material and the refractory metal outer leads to wet and coat that portion of the molybdenum foil exposed to the oxidizing environment.

Figure 1:
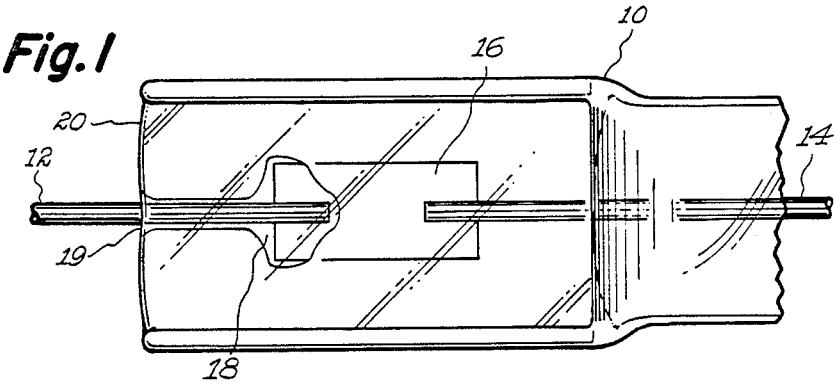
FIG. 1 is a view of a quartz envelope pinch seal containing a refractory metal inlead construction comprising a molybdenum sealing foil connected to an inner and outer lead.
Figure 1A:
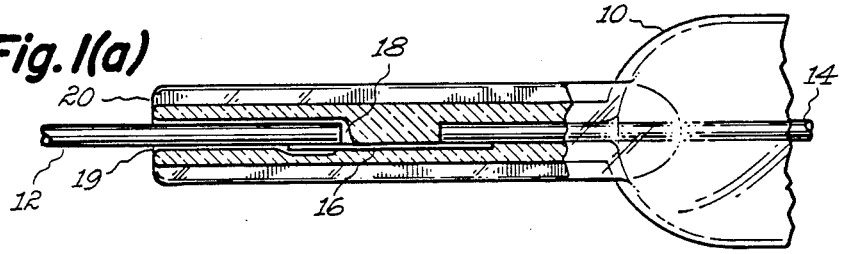

This can readily be understood by reference to FIGS. 1 and (1)*a* which are views of a typical quartz to molybdenum hermetic pinch seal. The hermetic seal comprises quartz envelope 10 having a refractory metal inlead construction pinch sealed into an end thereof, said inlead construction comprising an outer lead 12 and an inner lead 14 connected at opposite ends of molybdenum sealing foil 16. Because of a difference in thermal coefficient of expansion between the molybdenum and the quartz after the pinch seal has been formed and the quartz and metal components cool, an opening or cavity 18 (shown in an exaggerated manner for purposes of illustration) is formed between outer lead 12 and the quartz envelope. This cavity extends from the outer end 20 of the seal through to the outer end of molybdenum foil 16 due, at least in part, to the presence of the relatively thick outer lead attached to the relatively thin foil. In general, the diameter of outer and inner leads 12 and 14 will be in the order of about 30 mils, whereas the molybdenum foil generally has a thickness of less than about 2 mils, with the edges thereof etched to form a knife edge in order to effect a hermetic seal with the quartz envelope. Inner lead 14 may be connected to or form part of an electrode for an arc discharge lamp or can be connected to or form part of a filament, such as a tungsten filament, for a lamp such as a tungsten halogen lamp. Outer lead 12 may be covered with or connected to a thicker ferrule in order to provide the mechanical durability and strength needed to effect an electrical connection with a current source. An aqueous solution of alkali metal silicate may simply be applied to the outer face of the quartz envelope at the intersection 19 of the outer face 20 with outer lead 12 which is the outermost portion of cavity 18. As set forth above, a combination of wetting forces and capilary action cause the alkali metal silicate solution to penetrate into and fill cavity 18, thereby wetting and coating all of the exposed molybdenum. The alkali metal solution in the cavity may then be permitted to dry at ambient conditions or dried at elevated temperature.

As set forth above under SUMMARY OF THE INVENTION, in one embodiment of this invention the metal outer leads or outer lead wires will be coated or plated with a metal which does not adhere to the vitreous material of the lamp envelope (or arc tube) during the formation of the seal. This has been found to provide a more facile gap or opening between the outer lead and the surrounding vitreous material. One such suitable metal has been found to be nickel. Further, in some cases it has been found desireable to employ metal outer leads of a thickness substantially greater (i.e., $\geqq 40$ mils) than a thickness of, i.e., about 30 mils which is typically used in such lamp construction, in combination with a coating of a metal, such as nickel, which does not adhere to the quartz. This permits the alkali metal silicate solution to more readily and thoroughly coat the outer end of the molybdenum foil which will exposed to the atmosphere.

This latter embodiment of the present invention of employing relatively thick outer leads connected to the outer portion of the molybdenum sealing foil and preferably coating the leads with a material which does not adhere to the vitreous material of the lamp envelope runs contrary to the present practice of forming a pinch seal or vacuum seal as tightly as possible right up to and including the outer end of the seal. This is done in an attempt to make the outer portion of the seal area as airtight as possible. However, it has been found that some cracks or cavities invariably exist around the outer lead which admit air to the outer portion of the molybdenum sealing foil in the seal area.

FIG. 2 is a view of a typical tungsten-halogen lamp useful in the practice of this invention. The lamp comprises quartz envelope 10 containing two pinch-sealed inlead constructions comprising outer terminal leads 12 and 12′ and inner terminal leads 14 and 14′ connected to opposite ends of intermediate molybdenum sealing foils 16 and 16′, respectively. Tungsten filament 24 is attached at one end to inner lead 14 and at the other end to inner lead 14′. The alkali metal silicate solution is applied at the outer end 20 of the lamp envelope 10 at the junction 19 and 19′ of the outer leads 12 and 12′, respectively. This results in the alkali metal silicate solution penetrating into the cavities 18 and 18′ around outer leads 12 and 12′ and the outer portion of intermediate molybdenum sealing foils 16 and 16′.

FIG. 3 is a view of a double ended type of incandescent or tungsten-halogen lamp useful in the practice of the present invention. Thus, lamp 26 comprises quartz envelope 28 having intermediate molybdenum sealing foils 30 and 32 pinch sealed at opposite ends thereof. Foils 30 and 32 are connected to outer leads 34 and 36, respectively, with tungsten filament 38 connected to the other end of each of said foils 30 and 32. The alkali metal silicate solution is applied to the outer faces 39 and 40 of the pinch seal portions of lamp 26 at the intersections or junctions 41 and 42 of said outer faces with outer leads 34 and 36, which causes the solution to penetrate into the cavities (not shown) between the outer metal leads 34 and 36 and the vitreous envelope, through to the outer, exposed portions of sealing foils 30 and 32.

Figure 4:
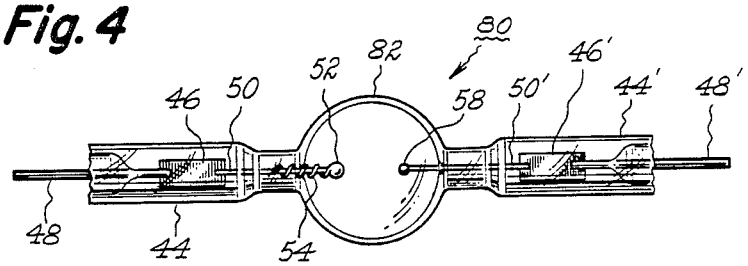
FIG. 4 is a view of an arc discharge lamp having a quartz to molybdenum hermetic pinch seal at each end thereof useful with the present invention.

FIG. 4 is a view of yet another type of lamp useful in the practice of the present invention. FIG. 4 illustrates a metal halide arc discharge lamp 40 comprising a quartz envelope 42 having quartz to molybdenum pinch seals at opposite ends 44 and 44′ thereof. The pinch seals each contain a refractory metal inlead construction comprising a molybdenum sealing foil 46 and 46′ to which are connected outer leads 48 and 48′, respectively, with inner leads 50 and 50′ being connected to the opposite ends of foils 46 and 46′, respectively. Inleads 50 and 50′ have balled ends 52 and 58, respectively, and in lead 50 also contains a hollow tungsten helix 54 spuded at the end thereof and terminating at its distal end in balled end of 52 of inlead 50. The hollow cavity of the quartz envelope contains argon or other inert gas and a charge comprising mercury along with metal halide such as $SCI_3$ and $ThI_4$. An aqueous alkali metal silicate solution is applied at the junction of outer leads 48 an 48′ to the ends of pinch seal portions or stems 44 and 44′, respectively. Again, this results in the alkali metal silicate solution penetrating into the cavity or cavities (not shown) between the outer leads and the quartz, through to the outer, exposed portion of the molybdenum sealing foils 46 and 46′.

Figure 5:
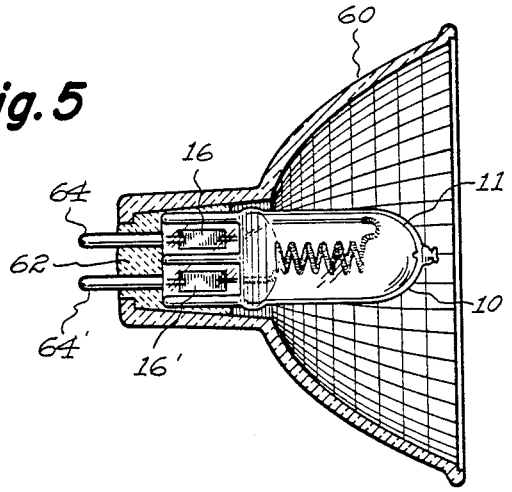
FIG. 5 is a view of a reflector and tungsten-halogen lamp combination useful with the present invention.

FIG. 5 is a partial cut-away view of a reflector and lamp combination employing the present invention, with the lamp being the type illustrated in FIG. 2. Thus, turning to FIG. 5, molded glass reflector 60 contains tungsten-halogen lamp 11 cemented in said reflector by cement 62. Lamp 11 comprises quartz envelope 10 pinch sealed at one end thereof onto two refractory metal inlead constructions comprising intermediate molybdenum sealing foils 16 and 16′ connected at one end to outer leads and at the other end to inleads which, in turn, are connected to the tungsten filament within the hollow portion of the quartz envelope. Ferrules 64 and 64′ are connected to the outer leads and extend from the outer end of the pinch seal end of the lamp through the cement 62 which secures lamp 11 into reflector 60. The lamp 11 has had an aqueous solution of alkali metal silicate applied to the back end thereof prior to assembly in the reflector, at the position of the outer lads. This causes the solution to penetrate into the cavities (not shown) between the outer leads and the quartz envelope, such that said solution penetrates through and fills the voids (not shown) at the outer end of foils 16 and 16' to coat the outer portion of the molybdenum sealing foils 16 and 16' exposed in the cavity formed in the seal by the cooling of the vitreous envelope material when said vitreous material cools after the pinch seal process.

Although the illustrations referred to above are for pinch seals employing a molybdenum foil seal which is parallel to the longitudinal axis of the seal area, the present invention can also be used with other types of seals. Thus, U.S. Pat. No. 4,161,672 discloses that suitable hermetic seals may be vacuum formed. The invention is also useful with seals between molybdenum and a vitreous material wherein the molybdenum foil is mounted on a lead like a flange, transverse to the longitudinal direction of the seal. Illustrative, but non-limiting examples of such seals are disclosed, for instance, in U.S. Pat. Nos. 2,518,944; 2,607,981; 2,699,847; 2,630,471 and 3,664,180.

It should be understood that the foregoing references to the Figures, etc. are intended to be illustrative and non-limiting with respect to the scope of the invention. The invention will be further understood by reference to the examples below.

EXAMPLE 1

In this experiment eight (8) double ended tungsten-halogen lamps having a quartz envelope and pinch seals were used. The lamps were similar in design and overall construction to that illustrated by FIGS. 3, except that the seals were vacuum formed. The vacuum seals were made to molybdenum foil connected at each end to molybdenum inner and outer lead wires. An aqueous solution of potassium silicate was applied to the outer end of each seal at the outer lead wire which resulted in the alkali metal silicate solution penetrating into the cavity between the quartz and outer lead through to the outer portion of the molybdenum foil seal. The alkali metal silicate solution appeared to fill up the cavity and wet the molybdenum in the cavity. The so-treated lamps were then dried in a furnace at 170° C. for 20 minutes.

The potassium silicate solution was an alkaline (pH of 11), low viscosity, water white, aqueous solution and contained 19.5% silicon dioxide as $SiO_2$ and 9.4% potassium oxide as $K_2O$. Thus the mole ratio of $SiO_2/k_2O$ in the solution was 3.25. This material was obtained from DuPont as their Potassium Silicate Electronics #200.

The treated, dried lamps were then placed in an oven at 450° C. and periodically examined. Out of eight lamps, one seal failure occurred after 871 hours. The test was discontinued after a total of 1479 hours at 450° C., with no further failures.

In marked contrast, another lamp of the same type which did not receive the potassium silicate solution treatment exhibited seal failure after only 143 hours at 450° C.

This experiment was repeated, but using an aqueous solution of 25 wt. % sodium silicate formed by dissolving sodium meta silicate ($Na_2SiO_3.9H_2O$) in distilled water. No signs of seal failure were observed after 350 hours at 450° C.

EXAMPLE 2

Another experiment was conducted similar to that of Example 1, except that the lamps were placed in a 600° C. oven. Four lamps were treated with the same potassium silicate solution and placed in a 600° C. oven, along with a control that did not have the potassium silicate solution applied to the seal area. The control exhibited seal failure after only 66 hours at 600° C. In contrast, none of the four treated lamps exhibited any seal failures after 1053 hours at 600° C., after which the test was discontinued.

EXAMPLE 3

One of the treated lamps of Example 1 was broken open after completion of the test and the treated foil portion of the seal analyzed with X-ray using the Debye Scherrer thin film technique. The x-ray discovered the presence of Mo, $MoO_2$, $K_2MO_3O_{10}$ and, possibly $MoO_3$ on the treated surface of the molybdenum foil.

EXAMPLE 4

In this example, the potassium silicate solution of Example 1 was applied to the seal area of over twenty 75 watt, quartz envelope, tungsten-halogen lamps of the type illustrated in FIG. 2 employing pinch seals over molybdenum foil connected to inner and outer leads. The outer leads were 30 mil molybdenum wire. The potassium silicate solution was applied to the seal area using a hypodermic syringe at the junction of the outer lead and the end of the seal area. After the solution had air dried for 24 hours and/or baked for 15 minutes at 300° C., the lamps were energized for accelerated life tests. The average life for the lamps was substantially greater than 1,000 hours. The average life of the same lamps without the alkali metal silicate seal protection was less than about 100–200 hours.

EXAMPLE 5

In this experiment, a number of reflector and lamp assemblies of the type set forth in FIG. 5 and described in both the present application and in U.S Pat. No. 4,021,659 were prepared and energized for accelerated life test performance. The lamps were identical to those employed in Example 4, with one hundred lamps having 30 mil diameter molybdenum outer wire leads and one hundred and fifteen having 60 mil diameter, nickel plated molybdenum outer leads. Prior to cementing the lamp into the glass reflector member, the potassium silicate solution of Example 1 was applied to the seal area of all of the lamps with the exception of nineteen lamps having the 30 mil outer lead wire which were used as controls. The lamps were air dried for 24 hours and/or baked for 15 min at 300° C. prior to being cemented into the reflectors. In some assemblies the cement used was a mixture of silica particles and potassium silicate solution, while others had an aluminum phosphate cement. The finished assemblies were energized for accelerated life test performance.

30 mil leads

The results for the lamps having the 30 mil leads and cemented into the reflector with the silica/potassium silicate cement reflected a fairly wide scatter of the data. Those lamps that did not have the potassium silicate solution applied to the seal area exhibited an average life of about 1,000 hours. Those lamps that did have the potassium silicate solution applied to the seal area had an average life of 1,500 hours where the solution had been baked for 15 min. at 300° C. and about 1,800 hours where the solution hasd been permitted to air dry for 48 hours prior to being cemented into the lamp.

The lamps having 30 mil leads that were cemented into the glass reflectors with the aluminum phosphate cement exhibited an average life of only 400 hours when no potassium silicate solution had been applied to the seal area and an average life of about 1,500 hours for those lamps that had the solution applied and were baked for 15 min at 300° C. prior to being cemeted into the glass reflectors. The average life of the lamps where the solution was air dried for 48 hours at room temperature before being cemented into the reflector was in excess of 2,000 hours, with three of the original eighteen lamps still burning after 3,500 hours.

60 mil nickel plated leads

The results for the lamps having the 60 mil nickel plated molybdenum outer leads were superior to the results obtained for the lamps having the 30 mil leads. Thus, for those lamps cemented into the glass reflectors with the silica/potassium silicate cement, of the lamps which did not have the potassium silicate solution applied to the seal area prior to assembly, two lamps out of an original group of eighteen were still burning after 3,200 hours. However, where the solution had been applied to the seal area, seventeen lamps out of original groups of nineteen and twenty were still burning after 3,200 hours.

The lamps that were cemented into the reflectors with the aluminum phosphate cement did not perform as well as those cemented with the silicate cement. Thus, the average life of a group of twenty lamps to which did not receive the potassium silicate treatment to the seal area was only about 900 hours. The average life of lamps that had been treated was in excess of 2,000 hours for those lamps that failed in less than 3,200 hours, with five and eight lamps still burning after 3,200 hours out of initial groups of nineteen and twenty, respectively.

What is claimed is:

1. A seal between molybdenum and a vitreous material having improved life when exposed to an oxidizing environment at elevated temperatures of at least about 250° C. wherein that portion of said molybdenum of said seal which is exposed to said oxidizing environment has been coated with an aqueous solution of alkali metal silicate.

2. The seal of claim 1 wherein that portion of said molybdenum exposed to said oxidizing environment contains a relatively uniform coating of said alkali metal silicate.

3. The seal of claim 2 being a hermetic seal.

4. The seal of claim 3 wherein said vitreous material is quartz or high temperatures glass.

5. The seal of claim 4 wherein said elevated temperature does not exceed about 600° C.

6. The seal of claim 5 wherein said alkali metal comprises potassium.

7. The seal of claim 5 wherein said alkali metal comprises sodium.

8. The seal of claim 5 wherein said alkali metal is selected from the group consisting essentially of potassium, sodium or mixture thereof.

9. An electric lamp comprising a vitreous envelope having at least one metal inlead construction hermetically sealed in at least one end thereof and extending into said end through at least one opening extending into said envelope wherein said inlead construction comprises an outer metal lead, an intermediate molybdenum sealing foil which forms said hermetic seal with said vitreous envelope and an inner lead extending into said envelope, said inner and outer leads being connected to said sealing foil, wherein the surface portion of said sealing foil which is adjacent said outer terminal lead is exposed to an oxidizing environment and has been coated with an aqueous solution of alkali metal silicate.

10. The lamp of claim 9 wherein said vitreous envelope is quartz or aluminosilicate glass.

11. A lamp according to claim 10 comprising a tungsten halogen lamp or an arc discharge lamp.

12. A lamp according to claim 11 wherein said inner and outer metal leads comprise refractory metal.

13. A lamp according to claim 12 wherein said outer lead is coated with a metal which does not adhere to said lamp envelope.

14. An electric lamp comprising a vitreous envelope having at least one refractory metal inlead construction pinch-sealed into at least one end thereof and extending into said through at least one opening extending into said envelope wherein said inlead construction comprises an outer terminal lead, an intermediate molybdenum sealing foil which forms a hermetic seal with said quartz envelope and an inner lead extending into said envelope, said inner and outer leads being connected to opposite ends of said sealing foil and wherein the surface of that portion of said molybdenum sealing foil adjacent said outer terminal lead is exposed to an oxidizing environment and has been coated with an aqueous solution of alkali metal silicate.

15. The lamp of claim 13 wherein said seal is a hermetic seal.

16. The lamp of claim 15 wherein said vitreous envelope comprises quartz or a high temperature glass composition.

17. A tungsten-halogen lamp according to claim 16.

18. The lamp of claim 17 wherein said envelope consists essentially of quartz.

19. An arc discharge lamp according to claim 18.

20. The lamp of claim 18 wherein said alkali metal comprises potassium.

21. The lamp of claim 18 wherein said alkali metal comprises sodium.

22. The lamp of claim 18 wherein said alkali metal consists essentially of potassium.

23. A reflector and lamp combination comprising (i) a vitreous reflector member having a front reflecting portion terminating in an elongated hollow cavity portion which protrudes rearwardly from said reflector member and (ii) a tungsten-halogen lamp permanently secured in said hollow cavity portion with a cement so that its light source is positioned at about the focal point of said reflector-member said tungsten-halogen lamp comprising a vitreous envelope having at least one refractory metal inlead construction hermetically sealed into at least one end thereof and extending into said end through an opening extending into said envelope wherein said inlead construction comprises an outer terminal lead, an intermediate molybdenum sealing foil which forms said hermetic seal with said vitreous envelope and an inner lead extending into said envelope, said inner and outer leads being connected to opposite ends of said sealing foil and wherein the surface of that portion of said molybdenum foil adjacent said outer terminal lead is exposed to an oxidizing environment and has been coated with an aqueous solution of alkali metal silicate.

24. The construction of claim 23 wherein said outer lead is coated with a mineral which does not adhere to said vitreous envelope.

25. The construction of claim 24 wherein said outer lead has a diameter of at least about 40 mils.

26. Molybdenum having improved resistance to oxidation at temperature between about 250°-600° C. the surface of which has been coated with an aqueous solution of alkali metal silicate which has been dried prior to exposure of said molybdenum to said temperature.

27. A process for improving the oxidation resistance of molybdenum at temperatures between about 250°-600° C. which comprises applying an aqueous solution of alkali metal silicate to the surface thereof and then drying said solution to form a coating of alkali metal silicate on said surface.

28. The construction of claim 24 wherein said alkali metal is selected from the group consisting essentially of potassium, sodium or mixture thereof.

29. The construction of claim 28 wherein said alkali metal consists essentially of potassium.

30. The molybdenum of claim 26 wherein said alkali metal is selected from the group consisting essentially of potassium, sodium or mixture thereof.

31. The molybdenum of claim 30 wherein said alkali metal consists essentially of potassium.

32. The process of claim 27 wherein said alkali metal is selected from the group consisting essentially of potassium, sodium or mixture thereof.

33. The process of claim 32 wherein said alkali metal consists essentially of potassium.

34. The lamp of claim 16 wherein said outer leads are coated with a metal which does not adhere to said lamp envelope.

35. The lamp of claim 34 wherein said alkali metal silicate consists essentially of potassium silicate, sodium silicate or mixture thereof.

* * * * *